US005189741A

United States Patent [19]

Beardmore

[11] Patent Number: 5,189,741

[45] Date of Patent: Mar. 2, 1993

[54] PATIENT LIFT AND TRANSPORTATION DEVICE

[75] Inventor: Robert L. Beardmore, 311 Linares Ave., Long Beach, Calif. 90803

[73] Assignee: Robert L. Beardmore, Long Beach, Calif.

[21] Appl. No.: 793,022

[22] Filed: Nov. 15, 1991

[51] Int. Cl.[5] ..... A61G 7/14; A61G 7/12

[52] U.S. Cl. ..... 5/86.1; 5/81.1

[58] Field of Search ..... 5/81.1, 83, 86, 87.1; 414/921

[56] References Cited

U.S. PATENT DOCUMENTS

| | | | |
|---|---|---|---|
| 3,277,502 | 10/1966 | Wauthier | 5/81.1 |
| 4,435,863 | 3/1984 | Lerich | 5/81.1 |
| 4,918,771 | 4/1990 | James | 5/81.1 |
| 5,001,789 | 3/1991 | Schoenberger | 5/81.1 |

*Primary Examiner*—Alexander Grosz

*Attorney, Agent, or Firm*—Edmund M. Jaskiewicz

[57] ABSTRACT

A device for transporting a patient in a standing/leaning position comprises a front frame extending upwardly from a wheeled base and a rear frame also extending upwardly. The rear frame has horizontal portions which are pivotally connected to the top of the front frame and the rear frame is further provided with a pair of under arm lifting bars. The front frame is further provided with a foot support at the bottom thereof and a knee support at substantially the midpoint thereof such that when the patient in the seated position places his feet on the foot support and knee support the rear frame can be pivoted forwardly so that the under arms of the patient are engaged by the lifting bars and the patient is lifted into a standing/leaning position by rearward pivoting of the rear frame. A modification of the device comprises a fixed rear frame with lifting arms extending forwardly therefrom and attached to the top of the front frame.

14 Claims, 5 Drawing Sheets

PATIENT LIFT AND TRANSPORTATION DEVICE

The present invention relates to a wheeled device for transporting a patient in a standing-leaning position, more particularly, to such a device which lifts a patient from a sitting position into a supported standing/leaning transportation position.

During the care of patients and disabled persons who do not have full control of their legs it is often necessary to move such persons from one position or location to another. If the patient is bedridden, it is necessary for one or more able bodied attendants to arrange the person into substantially a seating position and then to place the person on a conventional wheel chair for transportation to a new location. Various forms of hoists have been proposed which use seats, straps or slings which are positioned under the upper legs or bottom of a patient to lift the person. However, if the person is wet from body wastes, such slings or straps become soiled and must be cleaned or replaced after the patient has been cleaned. In addition, the presence of such straps or slings presented a significant obstacle to the dressing or undressing of such persons since considerable lifting or moving of the patient was required in order to put on or take off clothing. Such movements of the patients required considerable physical efforts on the part of the attendants. It has been estimated that 85% of health care workers either have or will receive back injuries from moving patients because of the necessity for bending of the back and then lifting a significant weight.

It has been proposed to provide a patient transfer apparatus which has a vertical column upstanding from a wheeled base. A knee support is mounted on the column and a padded chest support is pivotably mounted on top of the column. In such an apparatus, the feet of the patient are placed on the base, the knees are positioned against the knee support on the column and the patient is then pulled forward by the attendant to a position where his chest rests upon the pad. However, such an apparatus requires considerable physical exertion by the attendant in pulling the patient into position upon the pad and the machine does not provide any mechanical advantage for moving the patient from a sitting to a transfer position. There is no tilting of the base to facilitate positioning of the patient and after the feet and knees of the patient are positioned, the attendant must pull the patient into the transfer position with his chest resting upon the chest support.

It is therefore the principal object of the present invention to provide a novel and improved device for lifting and transporting a patient or disabled person.

It is another object of the present invention to provide such a device which transports a patient in a standing/leaning position and which provides a leverage structure for enabling a single attendant to position a patient on such a device in a transportation position.

It is another object of the present invention to provide such a device which enables a single attendant to lift a patient from a sitting position into a standing/leaning transportation position on the device.

It is an additional object of the present invention to provide such a device which is collapsable into a small size sufficient to fit in the trunk of an automobile and which is of sufficiently small size when in its operating state as to enable passage through all standard doors in a home and which does not require further modification of the construction facilities for use.

The objects of the present invention are achieved and the disadvantages of the prior art are overcome by the present invention which discloses a patient lift and transportation device in which a front frame extends upwardly from a wheeled base and a rear frame extends upwardly from the base to be connected with the top end of the front frame which is located substantially mid-way between the front and rear of the base. The rear frame is pivotally connected to the top end of the front frame and extending outwardly from the upper end of the rear frame is a structure for engaging under the arms of a patient when the rear frame is pivoted from a vertical to a beyond horizontal position. When the rear frame is pivoted back to its vertical position the patient will be lifted from a seated position into a transportation position on the device. The feet of the patient rest upon a foot rest located on the base or bottom of the front frame and the knees of the patient are braced against a knee support located on the front frame.

The device is further provided with auxiliary front wheels to enable the device to be tilted forwardly to a position limited by the auxiliary front wheels and thus to facilitate lifting of the patient by an attendant who can be much smaller in size than the patient to be lifted.

In a modification of the device, the rear frame has a pair of forwarding extending arms which are fixably attached to the top end of the front frame and the arms extend forwardly so as to provide support for a patient in the standing/leaning position on the device.

A safety belt similar to an automobile seatbelt may also be provided to retain the patient in the transportation position upon the device if such is necessary.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views, a specific embodiment and modifications of the present invention will be described in detail.

Figure 1:
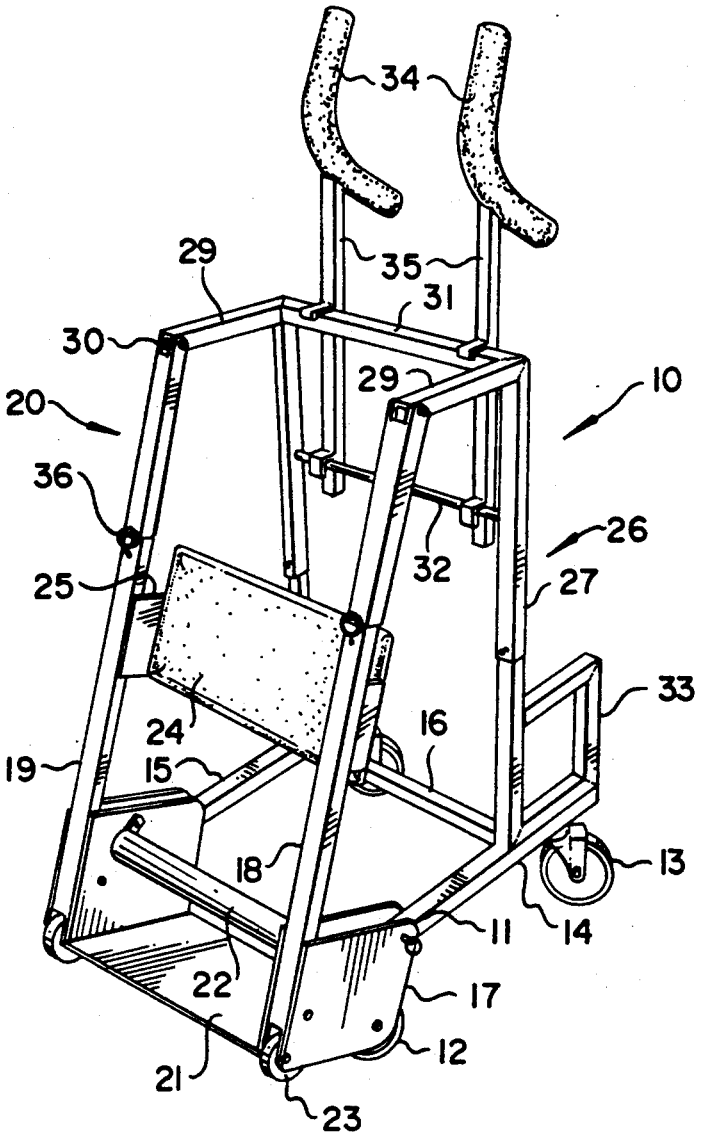
FIG. 1 is an overall perspective view viewed from the front and side of a patient lift and transportation device according to the present invention.

As may be seen in FIG. 1, the device according to the present invention is indicated generally therein at 10 and comprises a base 11 having front wheels 12 and caster rear wheels 13 which are thus pivotable. As known in the art, the pivotable rear wheels 13 are provided with locks.

The base 11 comprises a pair of longitudinal frame members 14 and 15 which are connected at their ends by a cross member 16. Longitudinal members 14 and 15 are each connected by a pair of front gusset plates 17 to upright frame members 18 and 19 which form a front frame indicated at 20 of the device. At the bottom of the front frame 20 is a platform 21 which interconnects the pairs of front gusset plate 17 and which functions as a foot rest or support for the patient. Positioned above the foot rest 21 is a cross member 22 which also interconnects the pairs of gusset plates and which is padded so as to provide a rest against which the legs of the patient may also press.

Figure 2:
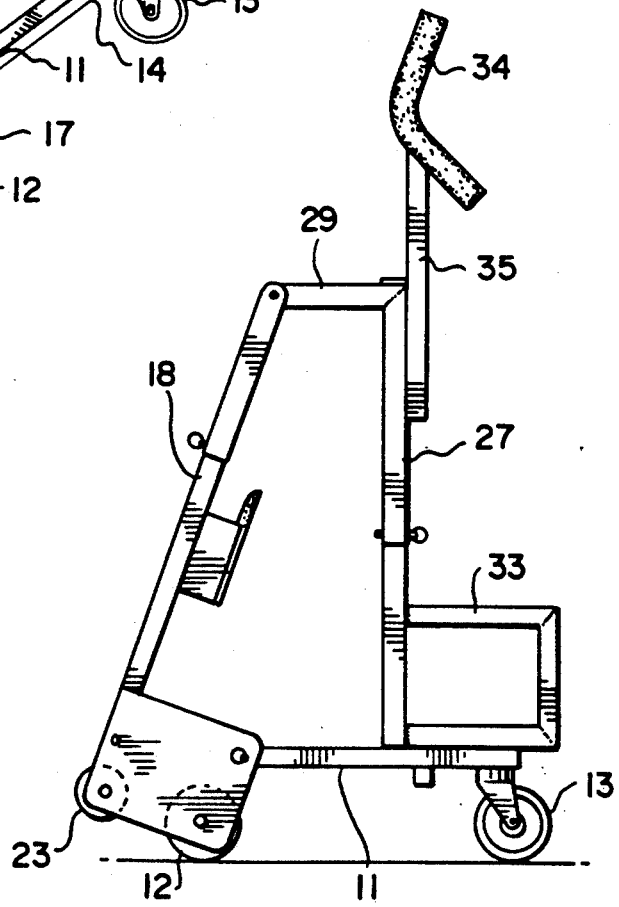
FIG. 2 is a side elevational view of the device shown in FIG. 1.
Figure 4:
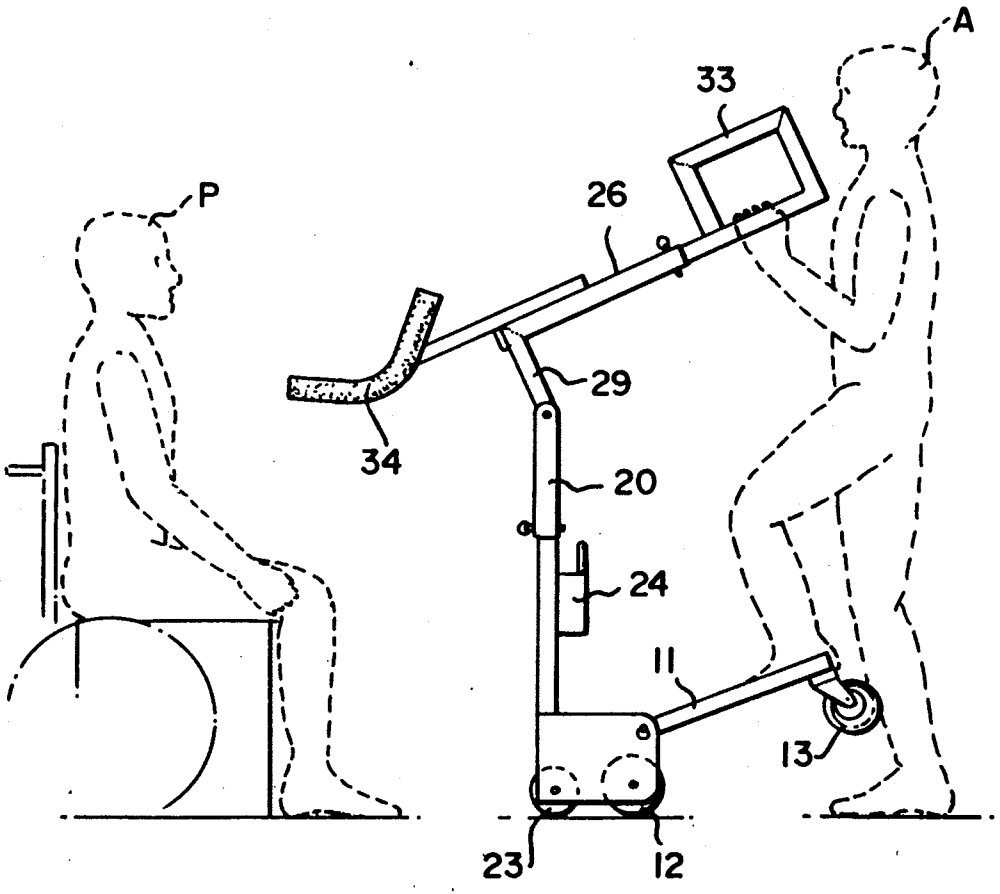
FIG. 4 is a side view similar to that of FIG. 2 but showing the device with the lifting bars in position to engage a patient.
Figure 3:
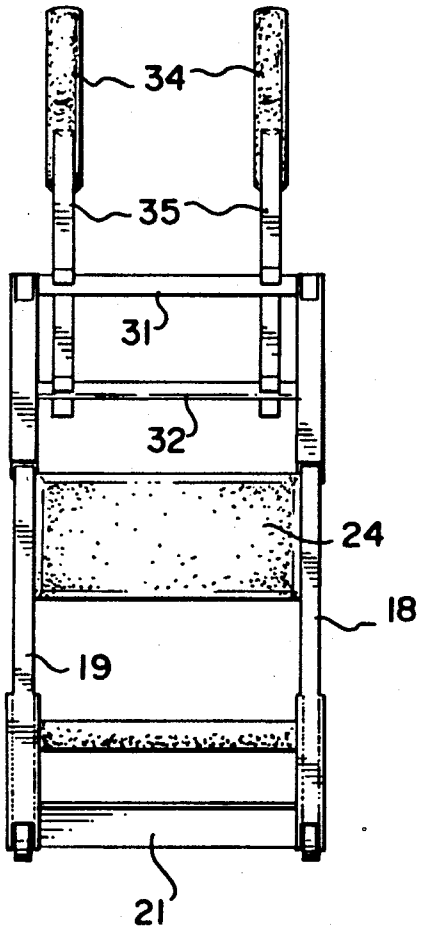
FIG. 3 is a front view of the device shown in FIG. 1.

A pair of auxiliary front wheels 23 are mounted at the front edges of the pairs of gusset plates 17 and at a slightly higher position as is shown in FIG. 2. The auxiliary front wheels limit the forward tilting of the device as shown in FIG. 4. In this tilted position, the center of gravity of the device will be between the wheels 12 and 23.

Figure 6:
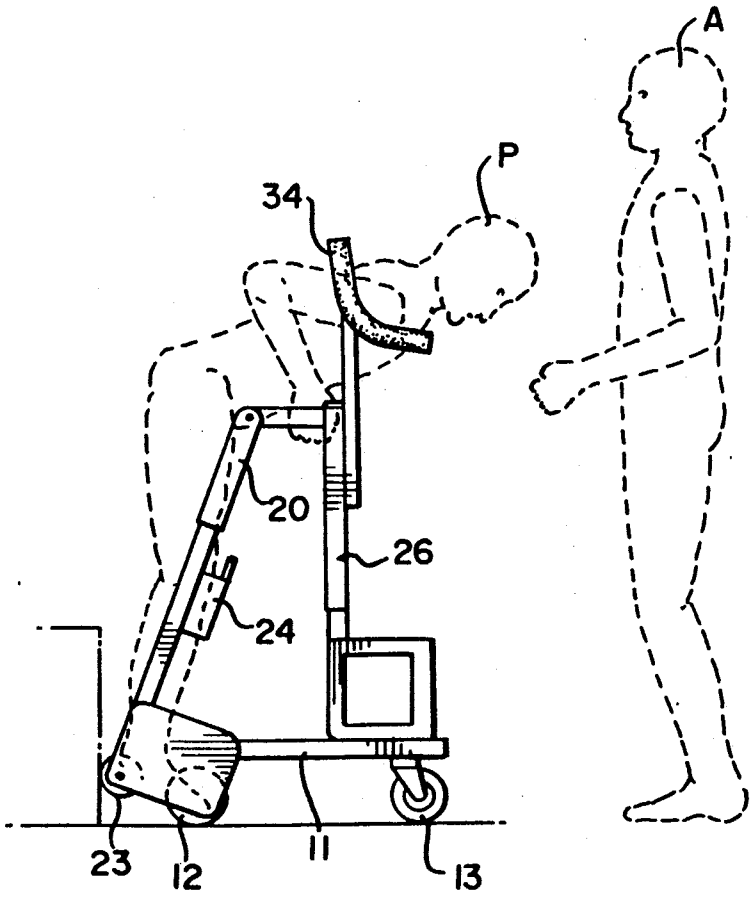
FIG. 6 is a view similar to that of FIG. 4 but showing the patient in the standing/leaning transportation position.

Positioned between the uprights 18 and 19 of the front frame 20 at a point substantially midway between the tops and bottoms of these members is a knee rest 24 attached by brackets 25 to the uprights 18 and 19. The knee rest 24 is also padded and supports the knees of a patient when in the transportation position as shown in FIG. 6.

Extending vertically upwardly from the rear end of the base 11 is a rear frame indicated generally at 26 and comprising a pair of vertical uprights 27 and 28 whose bottom ends rest upon the base. At the upper ends of the vertical members 27 and 28 there are horizontal members 29 each of which is then pivotally connected to the top ends of the front frame uprights 18 and 19 at 30. A top cross brace 31 interconnects the top ends of the uprights 27 and 28 and an intermediate brace 32 also interconnects these uprights at a point further down from the top as may be seen in FIG. 1. At the bottom ends of each of the rear frame uprights 27 and 28 is attached a loop shaped handle 33 which may be in the shape of a "D" as shown in FIG. 1 or which may be substantially square as shown in FIG. 2.

Extending upwardly and outwardly from the rear frame 26 is a pair of under arm lifting bars 34 each of which is mounted on the ends of extension arm 35. The curved lifting bars 34 are preferably padded to provide some comfort to the patient when in the lifting position. The arms 35 are mounted on the cross members 31 and 32 by clamps or hooks so as to be slidable thereon and movable laterally on the device.

The vertical members 18 and 19 of the front frame 20 and the vertical members 27 and 28 of the rear frame 26 are constructed of square steel tubing and a formed telescoping so that the height of the lifting device can be adjusted to accommodate patients of different sizes. Adjusting knobs 36 are shown on the forward faces of the vertical uprights. 18 and 19 to position the upper portions of each of these uprights into one of a series of openings formed along the front face of the lower portions of these uprights.

The other structural members as described above are also made from square steel tubing.

As may be seen in FIG. 1, the horizontal members 29 of the rear frame 26 are pivotally mounted at 30 and the pivot is formed by cutting a portion of the top front end of each of the vertical uprights to enable the horizontal members 29 to be pivoted to a position as may be seen in FIG. 4. The cut out portion on each of the vertical uprights 18 and 19 is such to limit the pivoting of the horizontal portions 29 to the position shown in FIG. 4 in which the rear frame 26 is in a beyond horizontal position.

When the device is in its normal or transportation position as shown in FIG. 4, the bottom member of the handle 33 rests flat upon one of the longitudinal members 14 or 15 of the base 11. The rear frame member 26 will be held in this vertical position primarily by the weight of a patient as will be later described. However, suitable quick-acting locks may be placed to secure the rear frame member 26 in its vertical position against the base as shown in FIG. 2.

In using the device according to the present invention, the device in its normal position as shown in FIG. 2, is moved toward a patient P who is preferably in a sitting position as shown in FIG. 4. The attendant A then pivots the rear frame 26 to its beyond horizontal position as also shown in FIG. 4 and tilts the device forwardly so that the rear wheels are lifted from the floor surface as also seen in FIG. 4 and the device is then moved toward the patient so that the under arm lifting bars 34 are enaged under the arms of the patient.

Figure 5:
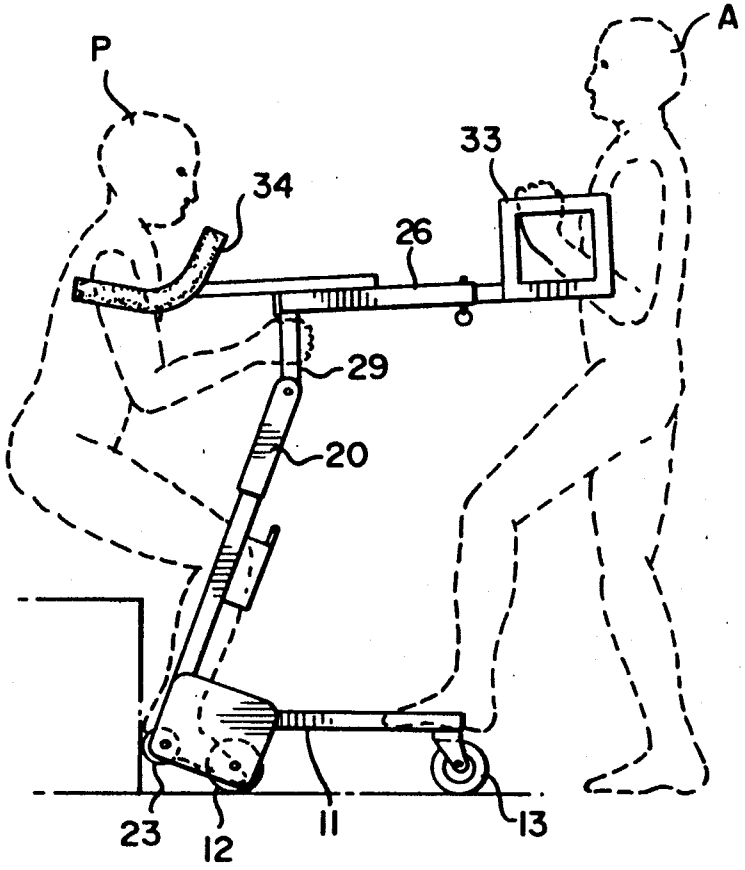
FIG. 5 is a view similar to that of FIG. 4 but showing the first stage in lifting the patient.

The base of the device is then lowered to the floor under the action of a foot of the attendant A to initiate the first stage in lifting the patient as shown in FIG. 5. At the same time, the rear frame 26 is being pivoted back to its original or vertical position until the rear frame reaches the vertical position as shown in FIG. 6. In this position the patient will be in the final standing-/leaning position as shown.

The front frame members 18 and 19 of the front frame 20 can be adjusted to proper lengths so that the hips of the patient are located as shown in FIG. 6 to enable the patient to bend forward slightly and at the same time to remain comfortable.

As an additional security measure, a suitable safety strap may be passed around the back of the patient and secured to the upper cross member 31 to prevent the patient from shifting position while the device is being moved to a new location with the patient being in the transportation position. The front wheels 12 and auxiliary wheels may also be provided with locks.

Figure 7:
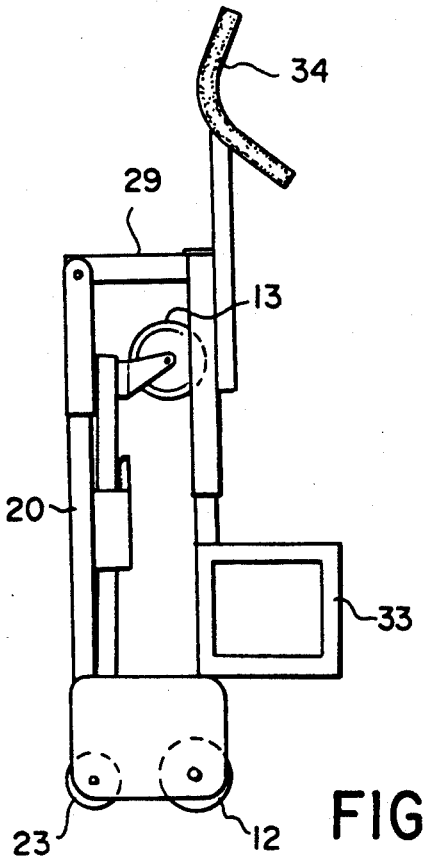
FIG. 7 is a side elevational view showing the device of the present invention in a first folded position.
Figure 8:
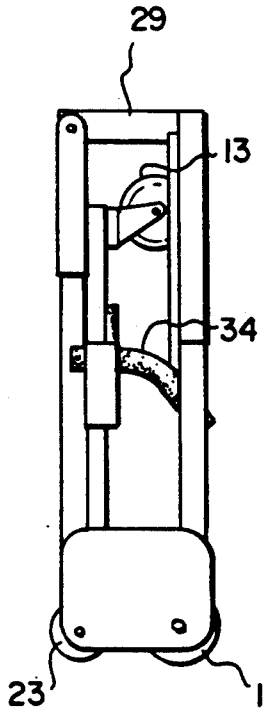
FIG. 8 is a view similar to that of FIG. 7 but showing the device in the folded transportation position.

The device as described above is preferably constructed so that it can be folded into the positions as shown in FIGS. 7 and 8 to facilitate transportation of the device itself between different locations. In such a folded form, the device can be accommodated in most automobile trunks.

It is pointed out that in the first stage of lifting of the patient as shown in FIG. 5, the patient, if he or she is able, will grip the horizontal member 29 to provide some assistance in being lifted. To facilitate this gripping by the patient, the horizontal member 29 may be padded or fitted with a rubber or artificial leather or rubber surface to facilitate gripping and to provide handles or grips for the patient.

Further, in the first stage of lifting as shown in FIG. 5, the feet of the patient are placed upon the foot rest 21 and the knees of the patient are positioned to contact the knee rest 24 in the manner as also shown in FIG. 5. The patient's feet and knees will remain in contact with the components when the patient is in the final or transportation position as shown in FIG. 6.

Figure 9:
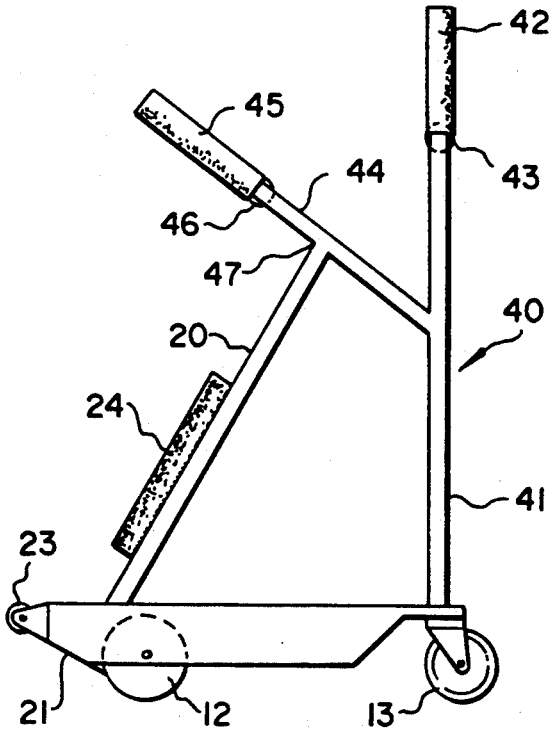
FIG. 9 is a side elevational view of a modification of the device shown in FIGS. 1–3.
Figure 10:
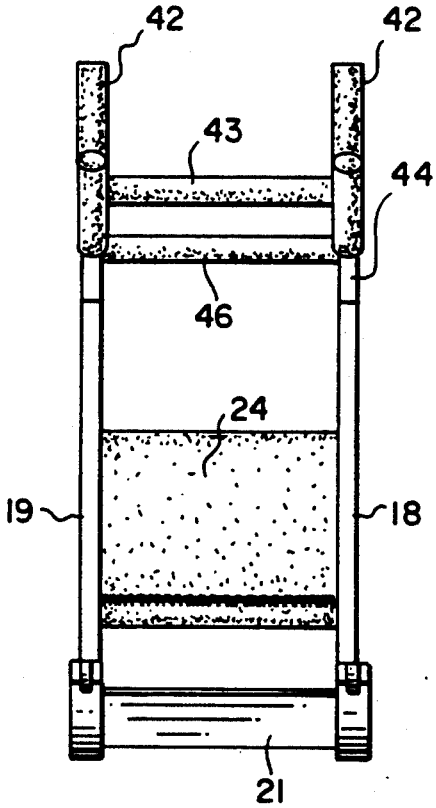
FIG. 10 is a front elevational view of the modified device shown in FIG. 9.

In FIGS. 9–12, there is disclosed a modification of the device described above which embodies a simplified structure in that the rear frame member is not pivotable. The modified device is indicated generally at 40 in FIG. 9 and similarly comprises a base 11, front wheels 12, pivotable rear wheels 13 and auxiliary wheels 23. There is also a foot rest 21 and a knee support 24 mounted on front frame 20. However, a rear frame 41 extends vertically upwardly from the rear of base 11 and is attached thereto. Similarly, the rear frame 41 comprises a pair of vertical uprights 42 which are interconnected by a transverse member 43 which is padded. From a point on the vertical upright 42 approximately midway between the top and bottom ends thereof, there extend a pair of arms 44 which are disposed at an acute angle to the horizontal as shown in FIG. 9. The ends of the arms 44 are padded at 45 to define under arm lifting bars and the arms 44 are interconnected by a cross member 46 which is padded. The parallel arms 44 are also connected to the top ends 47 of the uprights 18 and 19 of the front frame 20.

Figure 11:
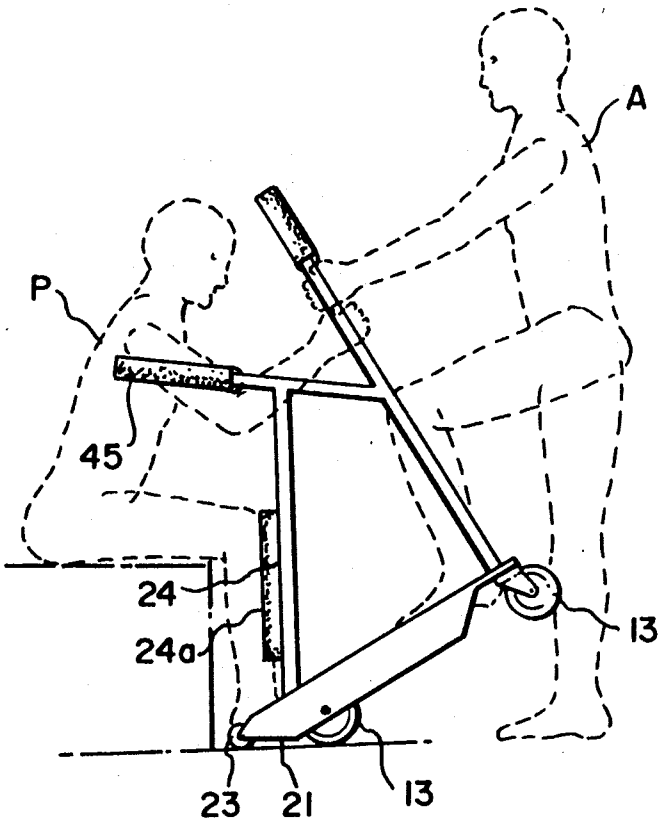
FIG. 11 is a side elevational view showing the modified device of FIG. 9 in the first stage in lifting a patient.
Figure 12:
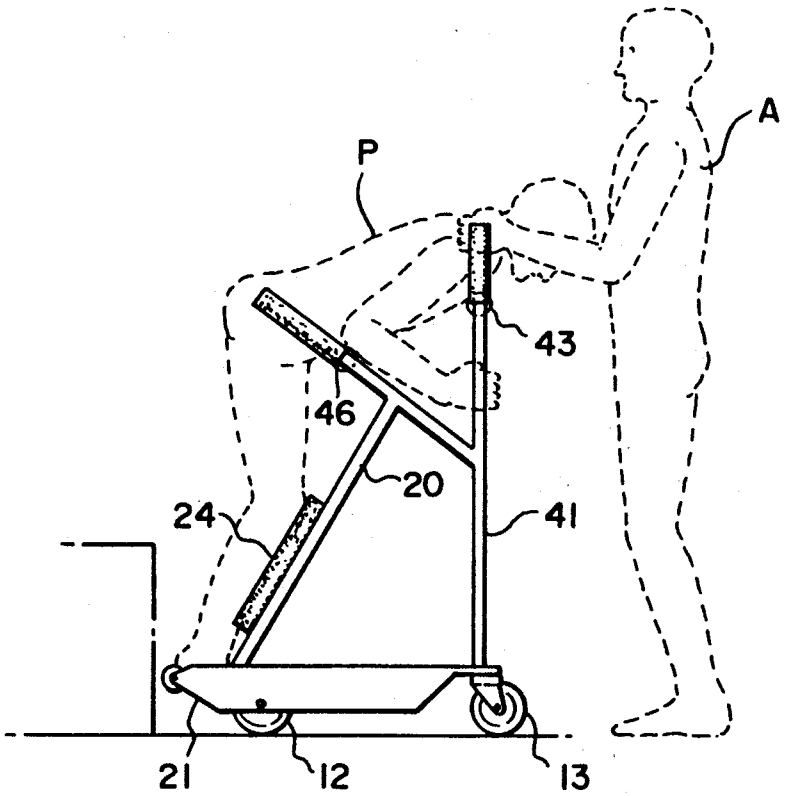
FIG. 12 is a side elevational view similar to that of FIG. 11 but showing the patient in the standing/leaning transportation position.

In operation, the attendant A approaches a patient P who is in the sitting position and subsequently tilts the device forwardly into a position defined by the auxiliary wheels 23 and front wheels 12 as shown in FIG. 11. The feet of the patient are then placed on foot rest 21 with the knees of the patient against the knee support 24 which may be provided with side plates **24*a* to prevent the knees of the patient from slipping off the knee support. When the knees are thus set against the knee support, the attendant may position a lifting belt under the arms and around the back of the patient and hook the lifting belt to the rear frame of the device. The attendant then steps on the rear of the device as also shown in FIG. 11 and exerts a force until the rear caster wheels 13 contact the floor. The attendant holds the device in this position with the foot and reaches for the lift belt to pull on the lift belt to move the patient to a semi-standing or standing/leaning position as shown in FIG. 12. The center of gravity of the patient is now located between the fixed front wheels 12 and pivotable rear wheels 13. The belt or strap holding the patient may then be locked or secured to prevent movement of the patient from the device and the device with the patient in the position as shown in FIG. 11** may then be wheeled to a new location.

It is to be noted that when the patient is in the transportation position as shown in FIG. 12, the arms 44 will be disposed on either side of the patnent's hips so as to hold the patient in position and to restrain the patient from lateral movement while in the transportation position.

The patient may also assist himself in lifting from the seated to the transportation position by holding onto the rear vertical upright 42 in the manner as shown in FIG. 11. In this position, the upper chest of the patient may be supported against the cross bar 43 and the patient may still be gripping the rear vertical uprights 42 to support himself.

Thus it can be seen that the present invention has disclosed a novel and improved wheeled device for transporting a patient in a standing/leaning position from one location to another. The device may also be used to facilitate the dressing or undressing of the patient since the device does not obstruct the body from the knee to the waist so that articles of clothing and other aids may be installed or removed. Further, the bottom of the patient and his upper legs can be cleansed while in the transportation position on the device. The device is human powered and may be used by a light weight person (90 lb.) to lift and transport a heavier person (200 lb.). The device utilizes mechanical advantages to perform the duty of lifting a person from the seated to the transportation position and the disabled person or patient is not required to use any of his or her strength for the transfer.

The device will also assist in positioning a person into a motor vehicle from the roadway or sidewalk depending on the height of the door and seat. Further, the device can assist a person in standing. The device can be utilized in connection with chairs, beds and other articles of furniture where there is no clearance under the furniture. The device is very fast and simple to use and a standard automobile seatbelt is utilized to secure someone onto the device and they are released merely by releasing the seatbelt in a normal manner.

It will be understood that this invention is susceptible to modification in order to adapt it to different usages and conditions, and accordingly, it is desired to comprehend such modifications within this invention as may fall within the scope of the appended claims.

What is claimed is

1. A device for transporting a patient in a standing-/leaning position comprising a base having front and rear wheels, a front frame extending upwardly from said base and having a top end, means on said base for supporting the feet of a patient to be transported, means on said front frame for supporting the knees of a patient positioned with his feet on said feet supporting means, and means comprising a rear frame extending upwardly from said base rearwardly of said front frame and pivotally connected to said top end of said front frame for supporting the upper body of a patient standing on said feet supporting means and having his knee supported on said knee supporting means, said rear frame having an upper end comprising means for engaging under the arms of a patient, whereby the underarm portion of a sitting patient can be engaged and upon pivoting of the rear frame from a beyond horizontal position to a generally vertical position, the patient is moved from a sitting position to a standing/leaning position on the transporting device.

2. A device as claimed in claim 1 wherein said front frame extends upwardly from the front of said base and is inclined rearwardly such that said top end is disposed between said base front and rear wheels, and said knee supporting means is on said front frame between the top and bottom thereof.

3. A device as claimed in claim 2 wherein said top end of said front frame is disposed at substantially the midpoint of said base.

4. A device as claimed in claim 1 wherein said rear wheels are pivotable.

5. A device as claimed in claim 1 and further comprising auxiliary front wheels is forwardly of and higher than said front wheels such that forward tilting of said device to facilitate transferring a patient into position on the device is limited by said auxiliary wheels.

6. A device as claimed in claim 1 wherein said front frame comprises a pair of spaced first frame members and said foot rest means and said knee rest means are mounted there between.

7. A patient lift and transportation device comprising a base having front and rear wheels, a front frame extending upwardly and rearwardly from the front of said base and having a top end disposed between said base front and rear wheels, a rear frame extending upwardly from the rear of said base and pivotally connected to said top end of said front frame for pivotal movement to a beyond horizontal position, means on the upper end of said rear frame for engaging under the arms of a patient when said rear frame is pivoted to its beyond horizontal position and for lifting the patient from a sitting position into a transportation position onto said device when said rear frame is pivoted to its vertical position, means at the bottom of said front frame for defining a foot rest for the feet of a patient, and means on said front frame between the top and bottom thereof for defining a support for the knees of a patient supported by said under arm engaging means when said rear frame is in its vertical position.

8. A device as claimed in claim 7 and further comprising handle means at the bottom of said rear frame for lifting said rear frame.

9. A device as claimed in claim 7 wherein said arm engaging means extend from the upper end of said rear frame and comprise a pair of curved lifting bars to be positioned under the arms of a patient.

10. A device as claimed in claim 7 and means on said front frame to limit pivotal movement of said rear frame.

11. A device as claimed in claim 7 wherein said rear frame comprises a pair of spaced second frame members and a spaced third frame member attached thereto for pivotal connection to said front frame.

12. A device as claimed in claim 7 wherein said rear frame has a bottom resting on said base when in the vertical position.

13. A device as claimed in claim 7 wherein said rear frame has a horizontally extending portion for pivotal connection to said top end of said front frame.

14. A device as claimed in claim 7 wherein said handle means comprises a loop-shaped member projecting rearwardly from said rear frame.

* * * * *